US005614690A

United States Patent [19]

Beauvais et al.

[11] Patent Number: 5,614,690

[45] Date of Patent: Mar. 25, 1997

[54] EQUILIBRATING DEVICE FOR A GUN

[75] Inventors: Arnault Beauvais, Bourges; Fabienne Mandereau, Saint Thorette, both of France

[73] Assignee: Giat Industries, Versailles, France

[21] Appl. No.: 489,149

[22] Filed: Jun. 9, 1995

[30] Foreign Application Priority Data

Jun. 16, 1994 [FR] France ..... 94 07353

[51] Int. Cl.[6] ..... F41A 27/30

[52] U.S. Cl. ..... 89/37.08; 89/37.07

[58] Field of Search ..... 89/37.08, 37.07, 89/43.02, 43.01

[56] References Cited

U.S. PATENT DOCUMENTS

| | | | |
|---|---|---|---|
| 2,066,319 | 1/1937 | Barnes | 89/43.01 |
| 2,349,124 | 5/1944 | Trotter | 89/43.01 |
| 4,158,324 | 6/1979 | Tidemalm et al. . | |
| 4,441,401 | 4/1984 | Hobson | 89/37.08 |
| 4,809,585 | 3/1989 | Wing et al. | 89/37.08 |

FOREIGN PATENT DOCUMENTS

| | | | |
|---|---|---|---|
| 0309646A2 | 4/1989 | European Pat. Off. . | |
| 0309646A3 | 4/1989 | European Pat. Off. . | |
| 0493762 | 7/1992 | European Pat. Off. | 89/37.08 |
| 2459466 | 1/1981 | France . | |
| 2022293 | 12/1979 | United Kingdom . | |

*Primary Examiner*—Stephen M. Johnson
*Attorney, Agent, or Firm*—Oliff & Berridge

[57] ABSTRACT

An equilibrating device for a gun having an oscillating mass mounted on a movable top carriage includes a gas chamber, a laying mechanism and an equilibration rod. The gas chamber contains a gas under pressure. The laying mechanism is connected to a gun and orients the oscillating mass with respect to the top carriage in a predetermined position. The laying mechanism has a laying axis and an elongate laying screw extending along the laying axis that applies a laying force to orient the oscillating mass. The equilibration rod is disposed to cooperate with the elongate laying screw and is connected to the gas chamber. The equilibration rod transmits an equilibration force exerted by the gas in the gas chamber along an equilibration axis in a direction opposite the laying force to reduce the laying force. The equilibration force varies in accordance with the laying force based on the predetermined position. As a result, the complexity of the laying mechanism and the equilibrating device can be reduced.

20 Claims, 4 Drawing Sheets

EQUILIBRATING DEVICE FOR A GUN

BACKGROUND OF THE INVENTION

The technical scope of the present invention is that of oscillating mass equilibrating systems, such as, for example, a piece of artillery mounted on a top carriage.

When a piece of artillery is mounted on a fixed or mobile top carriage, it needs to be oriented vertically according to the required firing conditions. This is usually carried out by a known laying device. When the propelling charge of the munition is initiated, the oscillating mass (barrel, breech block, etc.) recoils causing an unbalance that must be counteracted.

Equilibrating systems arranged between the top carriage and the oscillating mass are known. These systems generally include a spring or a nitrogen chamber that is arranged so that the pressure exerted by the nitrogen or the spring is opposed to the force exerted by the oscillating mass. The principal function of the equilibrating system is to counteract the strain created by the mass of the barrel to facilitate the laying operations of the gun.

In the device described in the document entitled "Cours de matériel d'artillerie", Rivals, 1955, a spring-based or gas-based equilibrator that does not take elevation laying into account is disclosed. A spring that is placed under tension after reaching a certain angle causes a abrupt change in the equilibrating curve gradient.

In the document entitled "US MIL SPECS" dating from 1990 and published by the U.S. Army, the equilibration is carried out by a nitrogen chamber. Calculations are made by studying the moment generated by the equilibrator (i.e., by observing the variation of the force and the position of a lever crank). The correction of the curve according to the external temperature is carried out by a pump that rebalances the initial pressure and by varying the length of the lever crank to change the equilibration moment at each laying angle.

In European Patent EP-A-309 646, the equilibrating pressure is adjusted by a valve according to the external temperature.

The main disadvantage of all known systems lies in the fact that the laying and equilibrating are carried out by independent systems. The resulting device is both cumbersome and very complicated because special connections must be provided for each of the two systems. Moreover, the spring used for the abrupt change in the equilibrating curve gradient must be specially manufactured and therefore is costly.

SUMMARY OF THE INVENTION

On aim of the present invention is to carry out the equilibration of an oscillating mass by directly counterbalancing the laying system.

The subject of the invention is thus an equilibrating device for an oscillating mass of the piece of artillery mounted on a top carriage that includes a nitrogen chamber exerting a strain between the oscillating mass and the top carriage. The nitrogen chamber cooperates with a laying mechanism to orient the oscillating mass with respect to the top carriage according to a laying axis represented for example, by a ball-screw that is disposed within the laying mechanism. An equilibrating axis that extends along a rod connected to the nitrogen chamber and cooperates with the laying screw reduces the laying force as much as possible.

According to another aspect of the invention, the equilibrating rod is disposed approximately coincident with the laying screw.

According to another aspect of the invention, the equilibrating device includes a body that surrounds the gas chamber, the laying screw and the equilibrating rod and wherein the piston is mounted immobile with respect to this screw and to this rod thereby demarcating an air chamber on the side of the laying screw and a nitrogen chamber on the side of the equilibrating rod.

According to another aspect of the invention, the equilibrating rod is mounted sliding with respect to the laying screw in an axial recess of the laying screw disposed near to its free end.

According to another characteristic of the invention, the air chamber is demarcated by a nut fixed to the body near the fixed end of the laying screw and sliding with respect to the laying screw when the oscillating mass is raised.

According to another characteristic of the invention, the equilibrating rod is mounted moving in translation under the action of a spring inside the recess on the laying screw. To limit this translation, a washer is fastened to the free end of the laying screw and a collar is fastened to the equilibrating rod.

According to another characteristic of the invention, the nitrogen chamber communicates with a nitrogen tank by retracting a blocking device activated by the equilibrating rod. The blocking device preferably includes a ball bearing positioned in a channel connecting the nitrogen chamber and the nitrogen tank, activated by a spring, the channel being for example fitted with a communicating opening between the nitrogen chamber and the tank and having a tip which limits the movement of the ball-bearing and through which passes the end of the equilibrating rod.

A first advantage of the device according to the invention lies in providing of a single mechanism ensuring both laying and equilibrating thereby simplifying the connection between the oscillating mass and the top carriage.

Another advantage lies in the fact that the difference between the laying and equilibrating strains is reduced.

Yet another advantage lies in the fact that the equilibrating strain has a direct influence on the laying device.

BRIEF DESCRIPTION OF THE DRAWINGS

Other characteristics, details and advantages of the invention will become clearer after reading the additional descriptions given hereafter with reference to the appended drawings wherein.

DETAILED DESCRIPTION OF PREFERRED EMBODIMENTS

Figure 1:
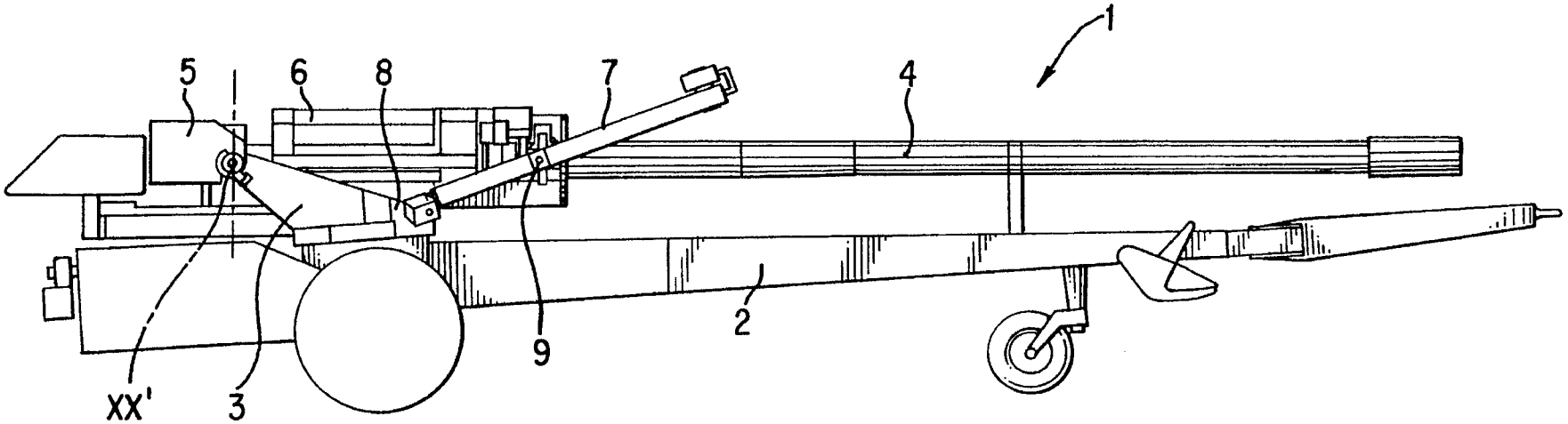
FIG. 1 is a top view of a piece of artillery mounted on a top-carriage.

FIG. 1 shows a piece of artillery 1 mounted on a mobile top carriage 3 by a bracket 2, mounted to swivel about an axis XX'. The recoiling mass includes the barrel 4 and the breech 5. As is known, the barrel 4 is integrally configured with brakes 6 to absorb the recoil of the oscillating mass generated by the firing of the propelling charge after a round has been discharged. The laying of the barrel 4 is carried out in a known manner by a laying system 7 fixed to the top carriage 3 by a bearing plate 8 and to the barrel 4 by a trunnion 9 that is driven by a screw.

Figure 2:
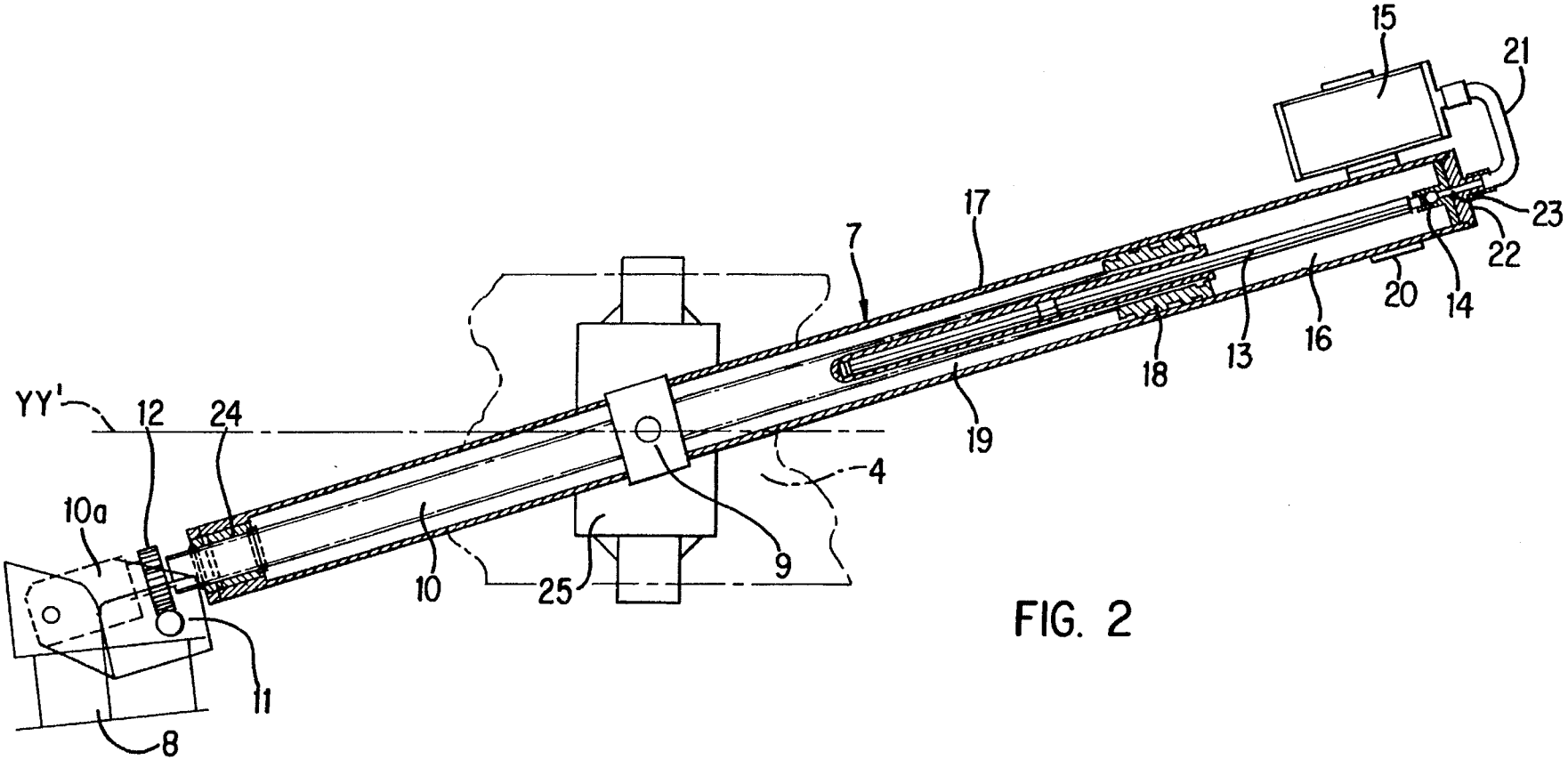
FIG. 2 shows a cross-section of the combined laying and equilibrating devices.

FIG. 2 describes the laying system in greater detail. The laying system 7 includes a ball screw 10 mounted to rotate with respect to its base 10*a*, which is integral with the bearing plate 8.

The screw 10 is rotated by a motor 11 attached to the base 10*a* that engages a gear 12 fixed to the screw to modify the laying of the barrel by the trunnion 9, of which the axis YY' is shown. The laying mechanism thus described is known. The screw 10 is approximately coincide with the laying axis. A rod extends along the laying axis and forms the equilibrating axis, the rod being connected at its free end to a blocking device 14 arranged between a nitrogen tank 15 and a gas chamber 16. To this end, a jack is provided that surrounds the screw 10 and the rod 13 in the following manner. A body 17 of the jack has a length such that it extends from the base 10*a* up to the blocking device 14 and a piston 18 of the jack is fixed at the free end of the screw 10, the piston separating the gas chamber 16 and the air chamber 19. The tank 15 is fixed on the body 17 of the jack by means of a collar 20 and is connected to the gas chamber 16 by a duct 21. The gas chamber 16 is bounded at one end by the piston 18 and at the other end by a cap 22 closing off the free end of the body 17. The cap includes a channel 23 linking the blocking device 14 to the duct 21. The screw 10 is further connected to the body 17 of the jack by a nut 24 attached to the immobile end of this body. As a result, when the screw 10 is rotated by the motor 11 to lay the barrel, the body 17 of the jack is moved in translation by the nut 24 and the trunnion 9 attached to the frame 25 of the gun. Moreover, because the piston 18 is attached to the screw 10, the body 17 of the jack slides with respect to this piston as the barrel is raised.

Figure 3:
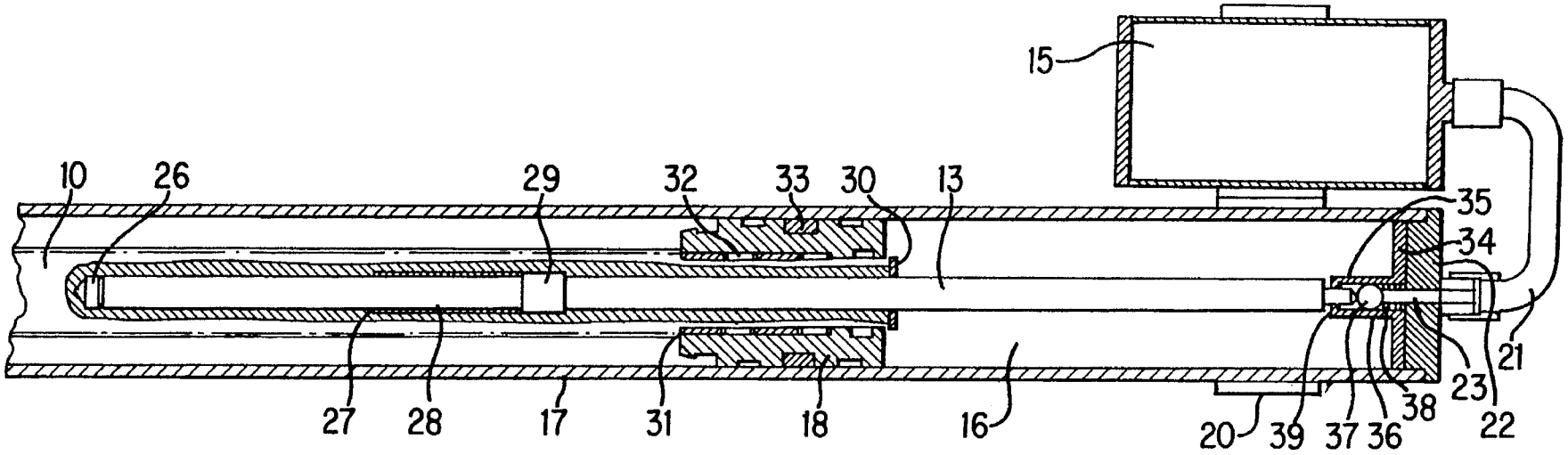
FIGS. 3 and FIG. 4 are cross-sections of the free end of the jack showing the blocking and opening of the nitrogen chamber.
Figure 4:
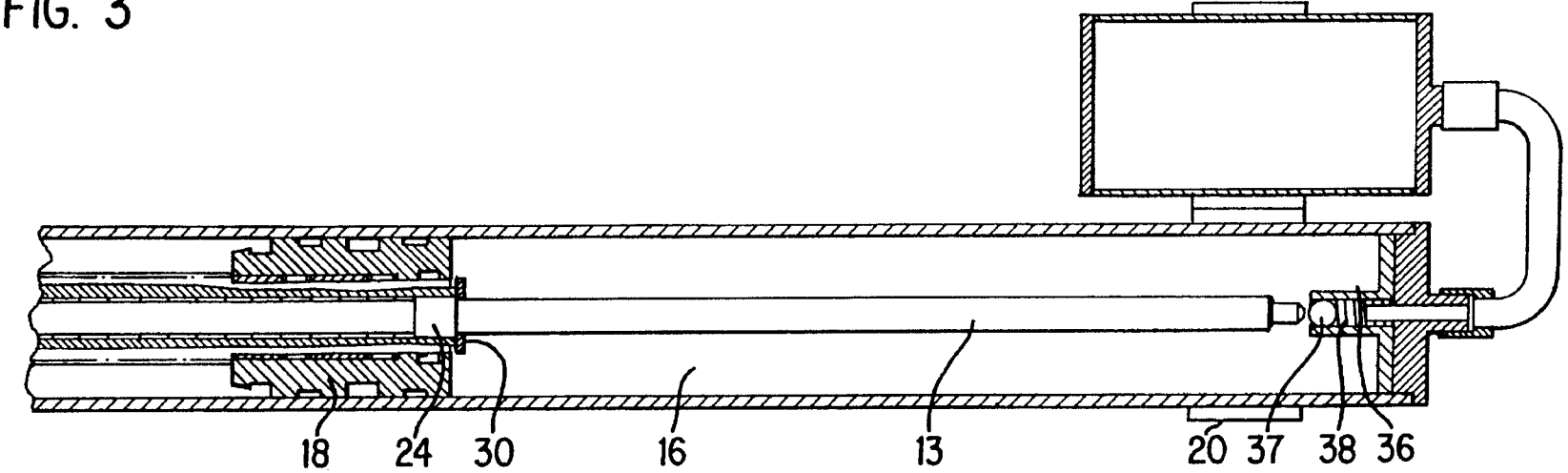

FIG. 3 shows a partial cross-section of the free end of the jack illustrating the end of the screw 10. The screw 10 has a recess 26 along it axis to accommodate the rod 13. The recess 26 has a shoulder 27 upon which a spring 28 exerts a force. This spring is arranged around the rod 13 and is compressed by the set collar 29 attached to the rod 13. The end of the screw 10 includes a washer 30 that serves as a stop for the collar 29 and a locking device for the piston 18. Thus, the rod 13 is mobile in translation inside the screw 10 between a low laying position, such as that shown schematically in FIG. 3, in which the spring 28 is compressed, and a position in which the collar 29 contacts the washer 30, the barrel being in a high laying position and the spring 28 being extended to its full extent, as shown schematically in FIG. 4. As may also be seen from FIG. 3 the end of the screw 10 includes a tapping accommodating the piston 18 that is immobilized between the shoulder 31 and the washer 30. Of course, the piston 18 includes seals 32 and 33 ensuring gas-tight fit between the piston screw 10 and the body 17. The gas 16 communicates with the nitrogen tank 15 by a channel 23 that passes through the cap 22. The blocking device 14 includes a plate 34 attached to the cap 22 from which a tube 35 extends, the tube having a communicating opening 36 between the chamber 16 and the tank 15. Inside the tube 35, a ball-bearing 37 obstructs the opening 36 under the action of a spring 38 that contacts the cap 22. The translation of the ball-bearing 37 is stopped by the tip 39 of the tube 35. Thus, when the high laying position shown in FIG. 4 is reached, the set collar 29 contacts the washer 30 and the rod 13 no longer activates the blocking device 14; the ball-bearing 37 is thereafter urged against the tip 39 by the spring 38. The opening 36 is thereby freed allowing an additional injection of gas into the gas chamber 16. Naturally, the spring 38 exerts less force than the spring 28.

The system functions as follows from the low laying position shown on FIG. 3 to a high position shown FIG. 4. First of all the starting pressure is adjusted by filling, the tank 15 communicating with the gas chamber 16 (high position), the pressure being set in accordance with the required strain, i.e., based on the mass of the barrel.

The gas chamber 16 exerts pressure on the piston 18 and on the body 17 of the jack. The pressure of the gas creates a strain on the body 17 to oppose the strain generated by the disequilibrium of the oscillating mass by contacting the rod 13 and the screw 10. The higher the laying angle, the lower is the strain to be produced. This result is obtained by increasing the volume of the gas chamber 16 by adjusting the distance of the cap 22 with respect to the piston 18. As a result, the pressure is reduced, thereby reducing the strain. As the laying angle increases, the cap 22 moves further from the piston 18, but the rod 13 remains urged against the ball-bearing 37 under the action of the spring 28. The chamber 16 remains closed. At a certain laying angle, the collar 29 contacts to the washer 30 (FIG. 4) thereby stopping the translation of the rod 13. From this position, the recoil of the piston 18 causes the recoil of the rod 13. The ball-bearing is then pushed back by the spring 38 to free the opening 36 and enable the nitrogen chamber 16 to communicate with the tank 15.

Figure 5:
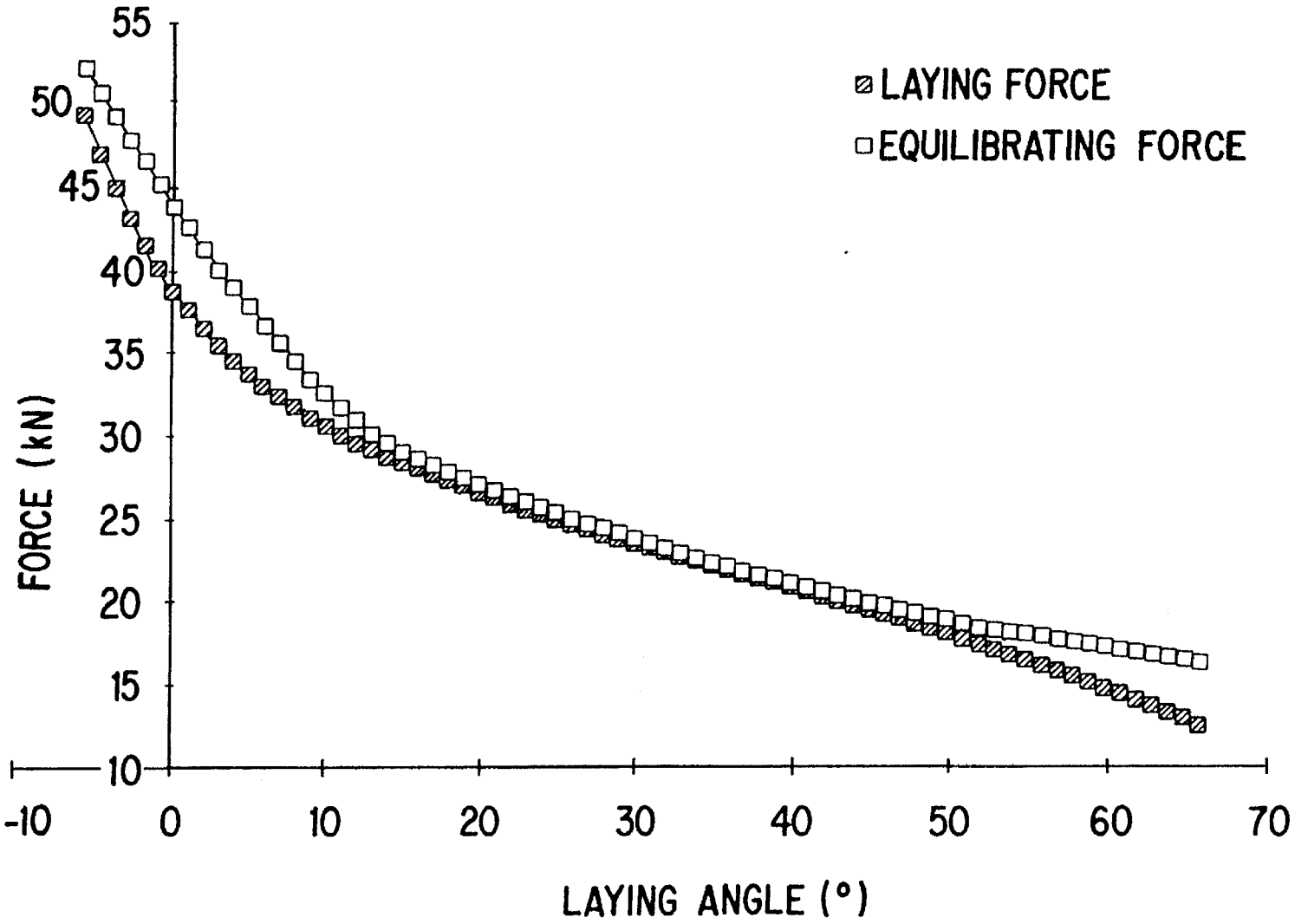
FIG. 5 shows the curves of the variation in laying force and equilibration force according to the laying angle.

In FIG. 5, the laying and equilibration curves (strain) are shown according to the laying angle. As may be noted, the device according to the invention prevents these two curves from intersecting which is what happens when equilibration is carried out with a single gas chamber. As the laying angle increases, the equilibration curve approaches the laying curve. The volume of the gas chamber 16 increases and the pressure reduction occurs more slowly. The slope of the equilibration curve is therefore less which prevents the curves from intersecting. The curves must be prevented from intersecting because the resultant strain would change directions and that the backlash elimination would also be carried out on two different sides. This would result in inaccuracies in the laying of the gun. Thus, with the device according to the invention, the backlash is always eliminated from the same side, which avoids prejudicing laying accuracy.

We claim:

1. An equilibrating device for a gun having an oscillating mass mounted on a movable top carriage, said equilibrating device comprising:

a gas chamber containing a gas under pressure;

a laying mechanism connected to said gun that orients the oscillating mass with respect to the top carriage in a predetermined position, said laying mechanism having a laying axis and an elongate laying screw extending along said laying axis that applies a laying force required to orient the oscillating mass; and an equilibration rod disposed to cooperate with said elongate laying screw and said gas chamber, wherein said gas in said gas chamber transmits an equilibration force in a direction opposite the laying force to reduce the laying force, said equilibration rod cooperating with said gas chamber such that the equilibration force varies in accordance with the laying force based on the predetermined position, said equilibrating device balancing the oscillating mass in order to counteract the weight of the gun by means of said equilibration force.

2. The equilibrating device of claim 1, wherein said equilibration rod is disposed approximately coincident with said laying screw and has a first end and a second end, said first end of said equilibration rod being coupled to a first end of said elongate laying screw.

3. The equilibrating device of claim 2, further comprising a body that surrounds said gas chamber, said laying mechanism and said equilibration rod, wherein said laying mechanism includes a piston disposed along said laying axis, said piston being stationary with respect to said elongate laying screw and having a first side that delimits a first end of said gas chamber within said body and a second side that delimits a first end of an air chamber within said body that is separate from said gas chamber, and wherein actuating said screw moves said piston, thereby changing a volume of said air chamber and of said gas chamber.

4. The equilibrating device of claim 3, wherein said first end of said elongate laying screw includes a recess shaped to slidingly receive said first end of said equilibration rod.

5. The equilibrating device of claim 4, wherein an end of said body adjacent said air chamber includes a nut threadedly connected to a second end of said laying screw, and wherein said nut is movable along said laying axis when said oscillating mass is oriented with said laying mechanism.

6. The equilibrating device of claim 5, wherein said elongate laying screw includes a spring that exerts a return force, said spring being disposed such that said return force urges said first end of said equilibration rod away from said first end of said elongate laying screw.

7. The equilibrating device of claim 6, wherein said equilibration rod includes a collar and said first end of said elongate laying screw includes a washer having an aperture shaped smaller than said collar to limit translation of said equilibration rod.

8. The equilibrating device of claim 1, further comprising a gas tank containing supply gas connected by a blocking device to said gas chamber, wherein said blocking device cooperates with and is actutatable by translation of said equilibration rod such that the supply gas flows under pressure from said gas tank to said gas chamber.

9. The equilibrating device of claim 8, wherein said blocking device includes a channel extending from said gas chamber through a body of said equilibrating device to said gas tank and a stop shaped to seal said channel and block said gas from flowing into said gas chamber, said stop being urged open by a stop spring in a normal position such that a pressure of said gas tank is approximately equal to a pressure of said gas chamber.

10. The equilibrating device of claim 9, wherein said channel includes an opening and a gas passage and said stop is a ball, said equilibration rod extending through said opening and contacting said ball, wherein said ball in said normal position allows the gas to flow from said gas tank to said gas chamber, and wherein in a stopped position, said equilibration rod urges said ball against a force exerted by said spring to move and to cover said gas passage such that the gas cannot flow into said gas chamber.

11. An equilibrating device for an oscillating mass mounted on a movable top carriage, said equilibrating device comprising:

a gas chamber containing gas under pressure;

a laying means for laying said gun, said laying means applying a laying force along a laying axis to orient said oscillating mass relative to said top carriage in a predetermined position; and an equilibration means for equilibrating said laying force, said equilibration means disposed to cooperate with said gas chamber and said laying means, wherein said gas in said gas chamber transmits an equilibration force in a direction opposite said laying force, said equilibration means being disposed to cooperate with said gas chamber such that said equilibration force varies in accordance with said laying force based on said predetermined position.

12. The equilibrating device of claim 11, wherein said equilibration means is coupled to and extends approximately coincident with said laying means.

13. The equilibrating device of claim 12, further comprising a body that surrounds said gas chamber, said laying means and said equilibration means, wherein said laying means includes a piston and an elongate laying screw, said elongate laying screw extending along said laying axis, said piston being disposed along said laying axis and stationary with respect to said elongate laying screw, said piston having a first side that delimits a first end of said gas chamber within said body and a second side forming one end of an air chamber within said body that is separate from said gas chamber, and wherein actuating said screw moves said piston, thereby changing the volume of said air chamber and said gas chamber.

14. The equilibrating device of claim 13, wherein said equilibration means includes an equilibration rod having a first end and a second end, said first end of said equilibration rod being coupled to a first end of said elongate laying screw, and wherein said first end of said elongate laying screw includes a recess shaped to slidingly receive said first end of said equilibration rod.

15. The equilibrating device of claim 14, wherein an end of said body adjacent said air chamber includes a nut threadedly connected to a second end of said elongated laying screw, and wherein said nut is movable along said laying axis when said oscillating mass is oriented with said laying means.

16. The equilibrating device of claim 15, wherein said elongate laying screw includes a spring having a return force, said spring being disposed such that said return force urges said first end of said equilibration rod away from said first end of said elongate laying screw.

17. The equilibrating device of claim 16, wherein said equilibration rod includes a collar and said first end of said elongate laying screw includes a washer having an aperture shaped smaller than said collar to limit translation of said equilibration rod.

18. The equilibrating device of claim 11, further comprising a gas tank connected to said gas chamber by blocking means for blocking supply gas urged to flow under pressure from said gas tank to said gas chamber, wherein said blocking means communicates with and is actutatable by translation of said equilibration means.

19. The equilibrating device of claim 18, wherein said blocking means includes a channel extending from said gas chamber through a body of said equilibrating device to said gas tank and a stop shaped to seal said channel and block said supply, said stop being urged open in a normal position by a stop spring in a normal position such that gas is flowable from said gas tank to said gas chamber.

20. The equilibrating device of claim 19, wherein said channel includes an opening and a gas passage and said stop is a ball, said equilibration rod extending through said opening and contacting said ball, wherein said ball in said normal position allows the gas to flow from said gas tank to said gas chamber, and wherein in a stopped position, said equilibration rod urges said ball against a force exerted by said spring to move and to cover said gas passage such that the gas cannot flow into said gas chamber.

* * * * *